US008695345B2

(12) United States Patent
Kawagishi et al.

(10) Patent No.: US 8,695,345 B2
(45) Date of Patent: Apr. 15, 2014

(54) CALCULATION METHOD OF MOISTURE LOSS IN STEAM TURBINE

(75) Inventors: Hiroyuki Kawagishi, Yokohama (JP); Akihiro Onoda, Yokohama (JP); Tomohiro Tejima, Yokohama (JP); Tomohiko Tsukuda, Kawasaki (JP); Asako Inomata, Yokohama (JP); Naoki Shibukawa, Saitama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 260 days.

(21) Appl. No.: 13/231,287

(22) Filed: Sep. 13, 2011

(65) Prior Publication Data

US 2012/0067045 A1 Mar. 22, 2012

(30) Foreign Application Priority Data

Sep. 16, 2010 (JP) ..... P2010-208229

(51) Int. Cl.
*F01K 13/02* (2006.01)

(52) U.S. Cl.
USPC ..... 60/649; 60/657; 415/1

(58) Field of Classification Search
None
See application file for complete search history.

(56) References Cited

U.S. PATENT DOCUMENTS

2009/0178468 A1 7/2009 Guo et al.

FOREIGN PATENT DOCUMENTS

JP 2009-168023 A 7/2009

OTHER PUBLICATIONS

"ASME International Steam Tables for Industrial Use", The Americal Society of Mechanical Engineers, CRTD, vol. 58, p. 158.

*Primary Examiner* — Kenneth Bomberg
*Assistant Examiner* — Wesley Harris
(74) *Attorney, Agent, or Firm* — Foley & Lardner LLP

(57) ABSTRACT

In one embodiment, a calculation method of moisture loss in a steam turbine calculates first a wetness fraction at the inlet and outlet of each of stationary blade cascades and rotor blade cascades. Subsequently, the moisture loss is classified into (1) supersaturation loss, (2) condensation loss, (3) acceleration loss, (4) braking loss, (5) capture loss and (6) pumping loss, and a loss for calculation of the moisture loss is selected from the above losses (1) to (6) according to the wetness fraction of steam at the inlet and outlet of each blade cascade. An amount of each selected loss is calculated, and an amount of moisture loss at each blade cascade is calculated.

4 Claims, 7 Drawing Sheets

CALCULATION METHOD OF MOISTURE LOSS IN STEAM TURBINE

CROSS-REFERENCE TO RELATED APPLICATIONS

This application is based upon and claims the benefit of priority from Japanese Patent Application No. 2010-208229, filed on Sep. 16, 2010; the entire contents of which are incorporated herein by reference.

FIELD

Embodiments described herein relate generally to a calculation method of moisture loss in a steam turbine.

BACKGROUND

Generally, steam as a working fluid in the steam turbine expands to high vacuum, so that it becomes wet steam containing water droplets over a saturated vapor line near an outlet of the steam turbine. In the steam turbine for thermal power generation, plural turbine stages including a low-pressure final turbine stage are operated by wet steam, and in the steam turbine for nuclear power generation or geothermal power generation, most of turbine stages are operated by wet steam.

When the steam turbine is operated by the wet steam, with the growth of water droplets generated in the turbine passage portion, there are problems related to performance and reliability which do not occur when the steam turbine is operated by the dry steam. The problems related to the performance include a moisture loss due to generation, growth and behavior of water droplets, and the problems related to the reliability include corrosion and the like caused by collision of water droplets against the rotor blades rotating at a high speed.

A ratio of the moisture loss to the total loss is high in the low-pressure turbine stage of the steam turbine for thermal power generation and in the multiple turbine stages of the steam turbine for nuclear power generation. Therefore, attempts have been made to calculate the moisture loss in the steam turbine.

As described above, the ratio of the moisture loss to the total loss is high, so that it is important to calculate the moisture loss with high accuracy from a view point of improving the performance of the steam turbine.

DETAILED DESCRIPTION

In one embodiment, an amount of moisture loss generated when a steam condition in a steam turbine becomes wet steam is calculated by an arithmetic processing unit. The calculation method of moisture loss in the steam turbine first calculates a wetness fraction at the inlet and outlet of each of a stationary blade cascade and a rotor blade cascade. Subsequently, the above moisture loss is classified as a thermal loss into (1) supersaturation loss generated when steam expands to supersaturate at the blade cascade and (2) condensation loss generated when steam around water droplets condenses, and as a mechanical loss into (3) acceleration loss generated due to a difference in velocity between water droplets and steam, (4) braking loss generated when water droplets collide against the suction sides of rotor blades, (5) capture loss generated when water droplets collide against the surfaces of the stationary and rotor blades, and (6) pumping loss generated when water droplets adhere to the surfaces of the rotor blades. And, a loss used for calculation of the moisture loss amount is selected from the above losses (1) to (6) according to the wetness fraction of steam at the inlet and outlet of the each blade cascade. Subsequently, the each selected loss is calculated for its amount, and the moisture loss amount at the each blade cascade is calculated based on the amount of the each calculated loss.

Embodiments will be described below with reference to the drawings.

Figure 1:
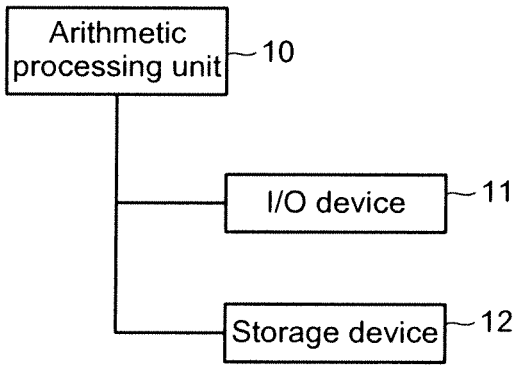
FIG. 1 is a structure diagram showing an overview of a computer that performs arithmetic processing according to a calculation method of moisture loss in a steam turbine of an embodiment.
Figure 2:
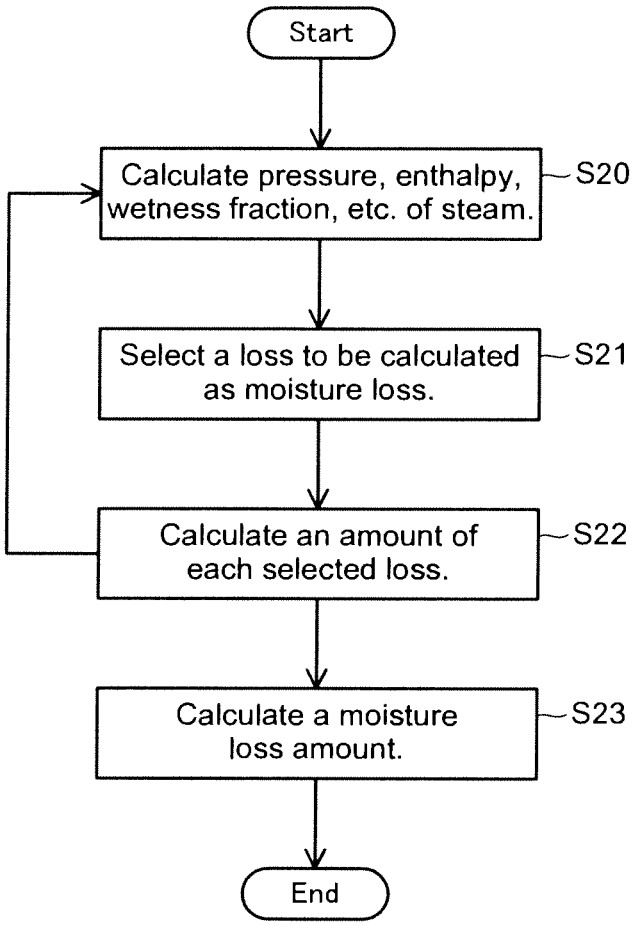
FIG. 2 is a flowchart showing a procedure of the calculation method of moisture loss in a steam turbine of the embodiment.

FIG. 1 is a configuration view showing an overview of a computer that performs arithmetic processing according to a calculation method of moisture loss in a steam turbine of an embodiment. FIG. 2 is a flowchart showing a procedure of the calculation method of moisture loss in the steam turbine of the embodiment.

As shown in FIG. 1, the computer is mainly provided with an arithmetic processing unit 10, an I/O device 11, and a storage device 12. The moisture loss amount in the steam turbine is calculated by the computer on the bases of data inputted from the I/O device 11, data previously stored in the storage device 12 and the calculated results obtained by the arithmetic processing unit 10 using such data.

The calculation method of moisture loss in the steam turbine of the embodiment calculates a moisture loss amount for each stationary blade cascade and for each rotor blade cascade. And, the calculation method of moisture loss in the steam turbine of the embodiment classifies the moisture loss into a thermal loss and a mechanical loss, and also classifies the thermal loss into a supersaturation loss and a condensation loss and the mechanical loss into an acceleration loss, a braking loss, a capture loss and a pumping loss.

The calculation method of moisture loss in the steam turbine of the embodiment is described below with reference to FIG. 2.

Basic specification requirements of the entire steam turbine, such as the number of turbine stages (one turbine stage has a stationary blade cascade and a rotor blade cascade) that the moisture loss amount is calculated, the number of rotations of the steam turbine, a steam pressure and steam temperature at the steam turbine inlet, and a steam pressure at the steam turbine outlet are inputted by the I/O device 11. And, the basic specification requirements of the turbine stage, such as a steam flow rate at each turbine stage, a steam pressure at the inlet and outlet of each turbine stage, an adiabatic heat drop at each turbine stage, a degree of reaction at each turbine stage are inputted by the I/O device 11.

And, coefficients such as a condensation coefficient Zw, an acceleration loss velocity ratio δa, a braking loss velocity ratio δb, a water collision rate Zi, a capture loss velocity ratio δc, a trailing edge deposition rate Zt, a stationary blade trailing edge deposition rate Ztn, and a blade surface deposition rate Zb, which are determined for each stationary blade cascade and each rotor blade cascade and used to calculate the amount of moisture loss, are previously stored in the storage device 12. It may also be configured to input the set values of the above various coefficients together with the above-described basic specification requirements.

According to the calculation method of moisture loss in the steam turbine, the arithmetic processing unit 10 first calculates a wetness fraction and the like of steam at the inlet and outlet of the stationary blade cascade and the rotor blade cascade configuring the turbine stage that the amount of moisture loss is calculated on the basis of the above input data (step S20). The steam pressure and enthalpy are also calculated when the wetness fraction of steam is calculated.

In the calculation in the step S20, for the stationary blade cascade inlet enthalpy, a rotor blade cascade outlet enthalpy at upstream by one turbine stage is used, and for the rotor blade cascade outlet enthalpy, an assumed value which is obtained according to an inlet steam condition and the adiabatic heat drop of each turbine stage is used. For the degree of reaction, a value determined according to design conditions and the like is used.

Subsequently, the arithmetic processing unit 10 selects various losses, which are used to calculate the moisture loss amount on the basis of the calculated wetness fraction, from the supersaturation loss, the condensation loss, the acceleration loss, the braking loss, the capture loss and the pumping loss (step S21).

has a temperature lower than that of the water droplets, and heat is released from the water droplets to the steam. This heat exchange is an irreversible change, so that a loss is generated, and it is a condensation loss.

When the water droplets are sprayed from the blade trailing edge, a frictional force is generated due to a difference in velocity between the water droplets and the steam, and energy of steam partly becomes a friction loss. This loss is an acceleration loss.

When the water droplets sprayed from the nozzle trailing edge collide against the rotor blades, the water droplets collide against the suction sides of the rotor blades at a high speed close to a peripheral velocity, and generate a braking force in a direction opposite to the rotating direction of the rotor blades, resulting in generation of a loss. This loss is a braking loss. The braking loss is a moisture loss generated at the rotor blades.

When the water droplets collide against the blade surfaces, kinetic energy that the water droplets have is lost to generate a loss. This loss is a capture loss.

When the water droplets adhere to the rotor blade surfaces and the adhered water droplets are moved toward the outer circumference side by pumping action, the loss corresponding to the work performed by the rotor blades on the water droplets is generated. This loss is a pumping loss. The pumping loss is a moisture loss generated by the rotor blades.

Table 1 shows various losses to be selected according to the wetness fraction. In Table 1, "1" denotes that selection is made, and "0" denotes that no selection is made. And, the boundary value of a wetness fraction of steam is denoted by $y_w$. The blade cascade in Table 1 denotes each of a stationary blade cascade and a rotor blade cascade. As described above, the braking loss and the pumping loss are losses generated on the rotor blade cascade.

TABLE 1

| | | | Blade Cascade Inlet | | | |
|---|---|---|---|---|---|---|
| | | | $y_i = 0$ | $0 \le y_i \le y_w$ | $0 \le y_i \le y_w$ | $y_i > y_w$ |
| | | | Blade Cascade outlet | | | |
| | | | $y_0 = 0$ | $0 < y_0 \le y_w$ | $y_0 > y_w$ | $y_0 > y_w$ |
| Moisture Loss | Thermal Loss | Supersaturation Loss | 0 | 1 | 1 | 0 |
| | | Condensation Loss | 0 | 0 | 1 | 1 |
| | Mechanical Loss | Acceleration Loss | 0 | 0 | 1 | 1 |
| | | Braking Loss | 0 | 0 | 0 | 1 |
| | | Capture Loss | 0 | 0 | 1 | 1 |
| | | Pumping Loss | 0 | 0 | 1 | 1 |

The individual losses are described below.

The supersaturation loss is a loss that is generated by an increase in entropy when steam near a saturated vapor line expands in the blade cascade and a heat drop is decreased by a supersaturation phenomenon to become smaller than in a case of saturation expansion not involving the generation of the supersaturation phenomenon and returns to an equilibrium state.

When steam expands in the steam passage of the steam turbine, the steam condensates around the water droplet nuclei generated after the supersaturation phenomenon to grow the water droplets. The steam around the water droplets As shown in Table 1, even when the steam condition becomes a wet region, the above-described individual losses do not generate at the same time, and the losses generated are variable depending on a range of wetness fraction.

For example, when a wetness fraction $y_i$ at the inlet of the blade cascade is expressed as $0 \le y_i \le y_w$ and a wetness fraction $y_o$ at the outlet of the blade cascade is expressed as $0 < y_o \le y_w$, the supersaturation loss is selected. When the wetness fraction $y_i$ at the inlet of the blade cascade is expressed as $0 \le y_i \le y_w$ and the wetness fraction $y_o$ at the outlet of the blade cascade is expressed as $y_o > y_w$, the supersaturation loss, the condensation loss, the acceleration loss, the capture loss, and the pumping loss are selected. When the wetness fraction $y_i$ at the inlet of the blade cascade is expressed as $y_i>y_w$, and the wetness fraction $y_o$ at the outlet of the blade cascade is expressed as $y_o>y_w$, the condensation loss, the acceleration loss, the braking loss, the capture loss, and the pumping loss are selected.

As described above, the supersaturation loss is selected when the wetness fraction $y_i$ at the inlet of the blade cascade is expressed as $0\leq y_i\leq y_w$ and the wetness fraction $y_o$ at the outlet of the blade cascade is expressed as $0<y_o\leq y_w$ or when the wetness fraction $y_i$ at the inlet of the blade cascade is expressed as $0\leq y_i\leq y_w$ and the wetness fraction $y_o$ at the outlet of the blade cascade is expressed as $y_o>y_w$. When the wetness fraction $y_i$ at the inlet of the blade cascade is expressed as $y_i>y_w$, it is determined that the supersaturation phenomenon has generated on the blade cascade of the upstream side, and the supersaturation loss is not selected.

The condensation loss is a loss due to the heat exchange when steam around the water droplet nuclei condenses after the generation of the water droplet nuclei at the Wilson point, so that it is selected when the wetness fraction $y_o$ at the outlet of the blade cascade is expressed as $y_o>y_w$.

Among the mechanical losses, the acceleration loss, the capture loss and the pumping loss are selected when the wetness fraction $y_o$ at the outlet of the blade cascade is expressed as $y_o>y_w$. And, the braking loss is selected when the wetness fraction $y_i$ at the inlet of the blade cascade is expressed as $y_i>y_w$. It is because the braking loss generated at the rotor blade is considered to be a loss which is generated because large water droplets are blown off from the trailing edge of the stationary blade located upstream of the rotor blade and steam at the inlet of the rotor blade has reached a sufficient wetness fraction.

Figure 3:
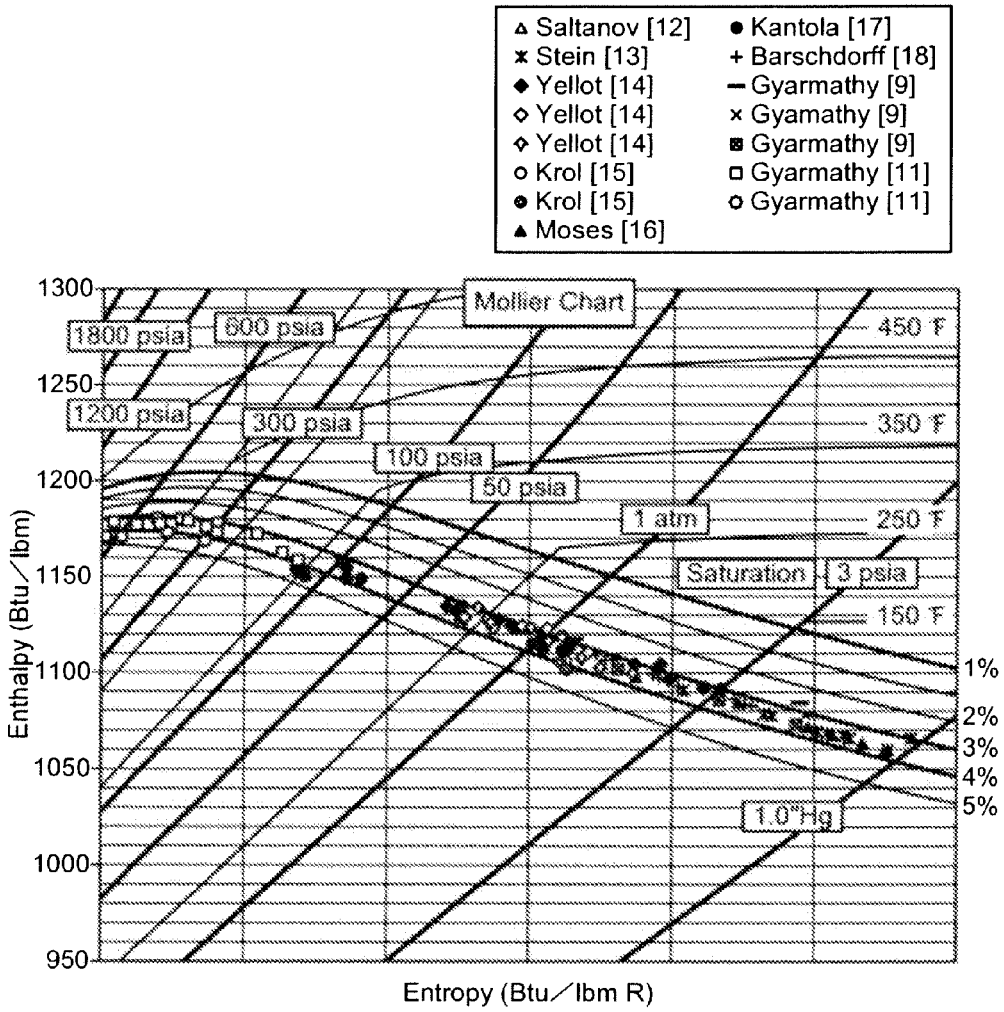
FIG. 3 is a Mollier chart showing an overview of experimental Wilson point data.

Here, it is preferable that the boundary value $y_w$ of the wetness fraction of steam is in a range of wetness fraction of 3% to 5%. FIG. 3 is a Mollier chart showing an overview of experimental Wilson point data. The Mollier chart shown in FIG. 3 cites the Mollier chart shown in FIG. 2 of the related reference (JP-A 2009-168023 (KOKAI)).

The boundary value $y_w$ of the wetness fraction of steam was preferably determined to be 3% to 5%, because the Wilson points are between 3 and 5% of the wetness fraction even if the pressure level changes as shown in FIG. 3.

Subsequently, the arithmetic processing unit 10 calculates an amount of each selected loss on the basis of the results calculated in the step S20, the data inputted from the I/O device 11, the data previously stored in the storage device 12 and the following calculation formula of each loss (step S22).

The calculation methods of the amounts of the above-described supersaturation loss, condensation loss, acceleration loss, braking loss, capture loss and pumping loss are described below.

(Supersaturation Loss)

A supersaturation loss amount Ls is calculated by the following expression (1).

[Mathematical expression 1]

$$L_s\Delta h_{ad}(1-\eta)G \qquad \text{Expression (1)}$$

Here, $\Delta h_{ad}$ is an adiabatic heat drop, $\eta$ is supersaturation efficiency, and G is a steam flow rate.

The supersaturation efficiency $\eta$ is described below.

Figure 4:
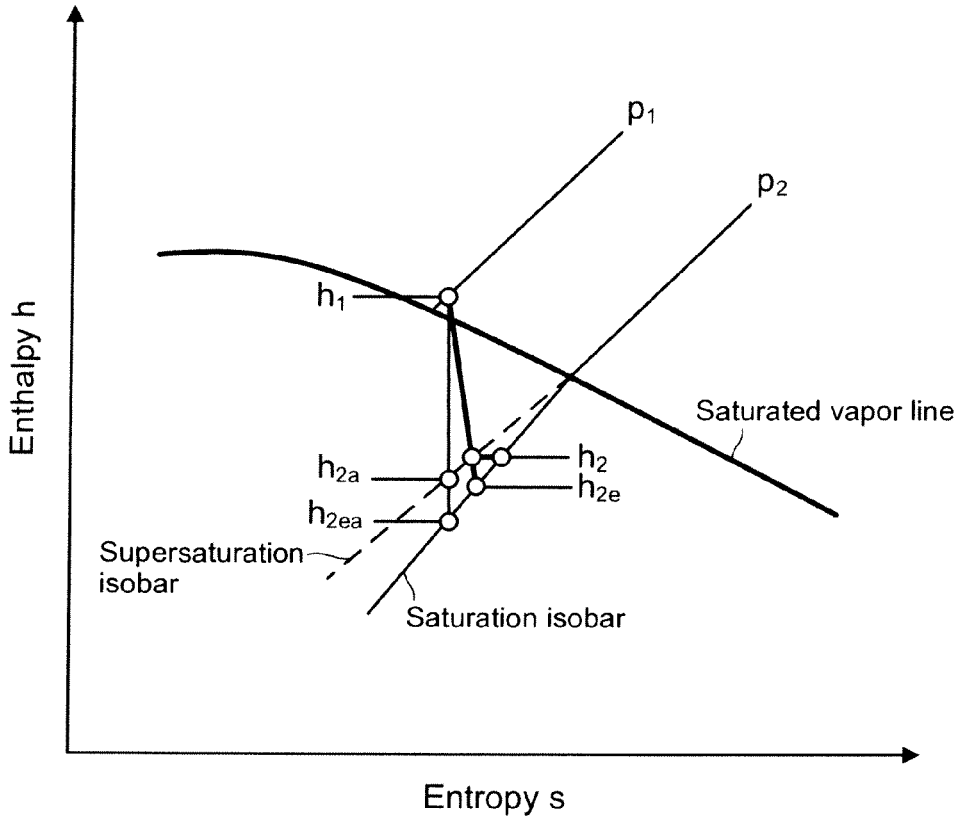
FIG. 4 is a view showing expansion curves of an enthalpy-entropy (h-s) diagram.

FIG. 4 shows an example of expansion curves in an enthalpy-entropy (h-s) diagram. As shown in FIG. 4, when it is determined that a blade cascade inlet pressure is $p_1$, a blade cascade inlet enthalpy is $h_1$, and expansion increases to a blade cascade outlet pressure $p_2$ crossing the saturated vapor line, the blade cascade outlet enthalpy becomes $h_{2e}$ by the saturation expansion but becomes $h_2$ on a supersaturation isobar by the supersaturation expansion. In addition, the entropy increases in a process of returning from the supersaturated state to the equilibrium state. There is also a method of calculating an increased amount of entropy as a calculation method of supersaturation loss as in the related reference (JP-A 2009-168023 (KOKAI)), but it is not a method suitable for the design calculation because a very small water droplet diameter which is hardly identified becomes a factor of loss, and the loss tends to change largely depending on the size of the water droplet diameter. Therefore, the following method is adopted in this embodiment.

In the case of the supersaturation expansion, steam which has fallen in a wet region does not immediately have characteristics of wet steam but has characteristics of dry steam until the Wilson point that water droplet nuclei generate. Differences in characteristics between the dry steam and the wet steam are indicated by using a dry specific heat ratio $\kappa_d$ and a wet specific heat ratio $\kappa_w$, and the supersaturation efficiency $\eta$ is defined by an expression (4) derived from energy relational expressions (expression (2) and expression (3)) assuming an adiabatic change and enthalpies $h_{2a}$ and $h_{2ea}$ on an adiabatic diagram.

[Mathematical expression 2]

$$h_1 - h_{2a} = \frac{K_d}{K_d - 1} p_1 v_1 \left[1 - \left(\frac{p_2}{p_1}\right)^{\frac{(K_d-1)}{K_d}}\right] \qquad \text{Expression (2)}$$

[Mathematical expression 3]

$$h_1 - h_{2ea} = \frac{K_w}{K_w - 1} p_1 v_1 \left[1 - \left(\frac{p_2}{p_1}\right)^{\frac{(K_w-1)}{K_w}}\right] \qquad \text{Expression (3)}$$

[Mathematical expression 4]

$$\eta = \frac{h_1 - h_{2a}}{h_1 - h_{2ea}} = \left(\frac{K_d}{K_d - 1}\right)\left(\frac{K_w - 1}{K_w}\right)\left[\frac{1 - (p_2/p_1)^{(K_d-1)/K_d}}{1 - (p_2/p_1)^{(K_w-1)/K_w}}\right] \qquad \text{Expression (4)}$$

Figure 5:
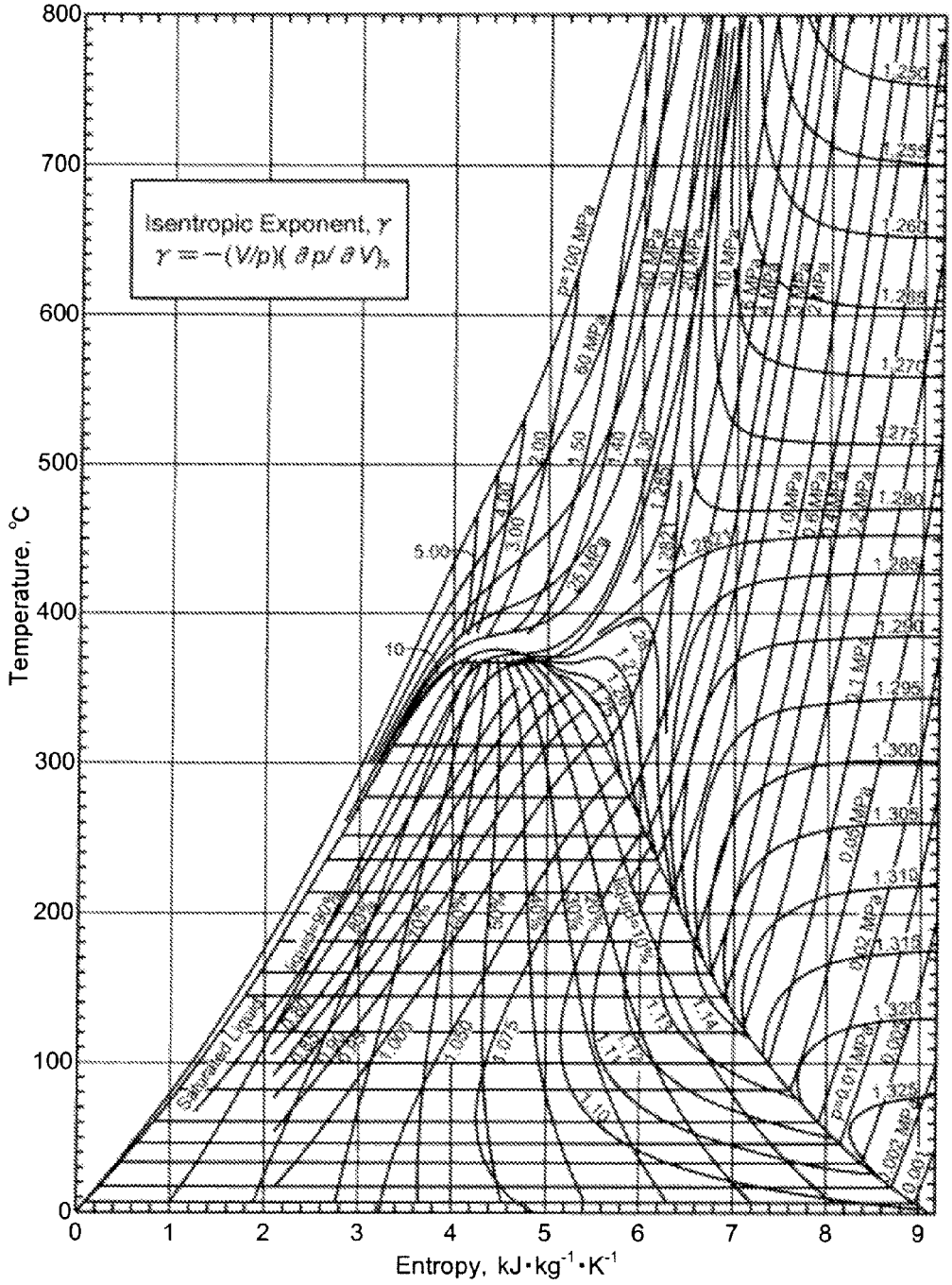
FIG. 5 is specific heat ratio curves of a temperature-entropy diagram.

FIG. 5 shows specific heat ratio curves of a temperature-entropy chart. FIG. 5 cites the specific heat ratio curves shown in "ASME INTERNATIONAL STEAM TABLES FOR INDUSTRIAL USE", p. 158.

As shown in FIG. 5, the specific heat ratio is characteristic on the points that it is variable depending on steam conditions, and particularly it is variable largely near the saturated vapor line which is a boundary line between the dry region and the wet region. Accordingly, as the dry specific heat ratio $\kappa_d$ in the expressions (2) to (4) described above, the dry side specific heat ratio at the position where the expansion curves and the saturated vapor line intersect mutually is used, and as the wet specific heat ratio $\kappa_w$, the specific heat ratio at the position where the blade cascade outlet pressure and the blade cascade outlet wetness fraction intersect mutually is used.

The dry specific heat ratio $\kappa_d$ and the wet specific heat ratio $\kappa_w$ under each steam condition are created as data on the basis of the specific heat ratio curves shown in FIG. 5 and stored in the storage device 12 in advance. And, the arithmetic processing unit 10 performs the above-described calculation upon reading out the dry specific heat ratio $\kappa_d$ and the wet specific heat ratio $\kappa_w$ stored in the storage device 12 on the basis of the each steam condition.

Figure 6:
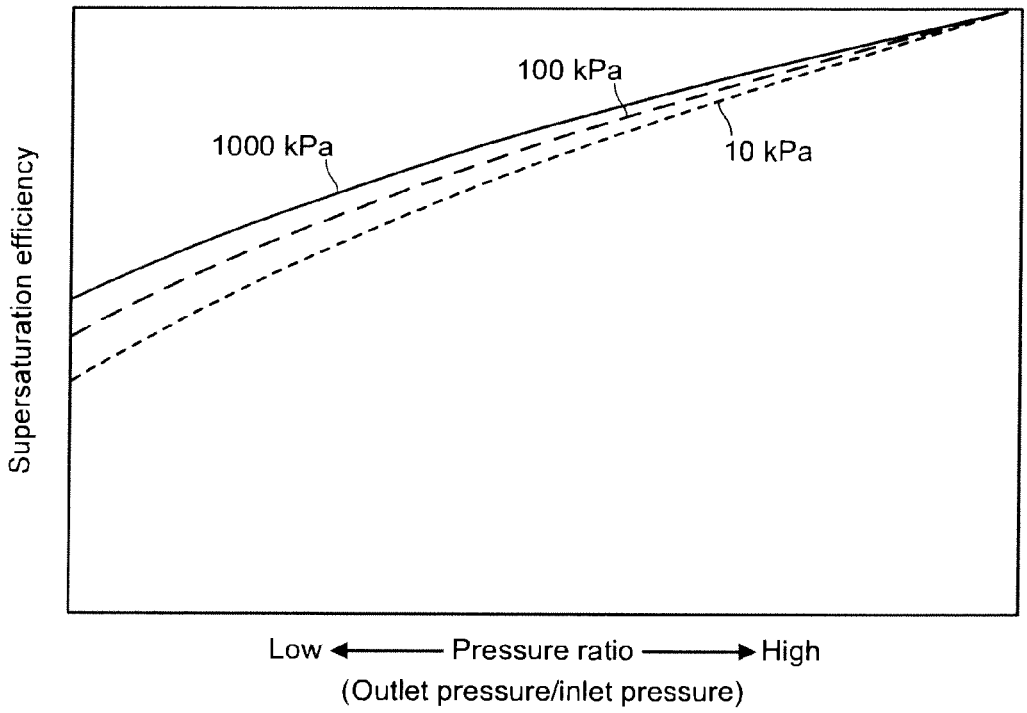
FIG. 6 is a view showing characteristics of supersaturation efficiency η when a pressure ratio (blade cascade outlet pressure/blade cascade inlet pressure) changes.

FIG. 6 is a diagram showing the characteristics of the supersaturation efficiency η when a pressure ratio (blade cascade outlet pressure/blade cascade inlet pressure) changes. As the specific heat ratio when the supersaturation efficiency η is calculated, the above-described dry specific heat ratio $\kappa_d$ and wet specific heat ratio $\kappa_w$ were used.

As shown in FIG. 6, the supersaturation efficiency tends to decrease as the pressure ratio becomes smaller. It indicates that the difference between the heat drop in the saturation expansion and the heat drop in the supersaturation expansion increases as the pressure ratio becomes smaller. And, even if the pressure ratio is same, the supersaturation efficiency is variable depending on the difference of pressure level, and the supersaturation efficiency tends to decrease as the pressure becomes lower. It is due to the change of the dry specific heat ratio $\kappa_d$ and the wet specific heat ratio $\kappa_w$ which are determined in FIG. 5 depending on the pressure level.

As described above, when the dry specific heat ratio $\kappa_d$ and the wet specific heat ratio $\kappa_w$ which are functions of pressure, temperature and wetness fraction are used to calculate the supersaturation efficiency η, a more appropriate specific heat ratio can be used. Thus, the supersaturation efficiency η can be calculated more precisely.

(Condensation Loss)

A condensation loss amount $L_q$ is calculated by the following expression (5).

[Mathematical expression 5]

$$L_q=h_{fg}\Delta G_w z_w \quad \text{Expression (5)}$$

Here, $h_{fg}$ is latent heat, $\Delta G_w$ is an increased water amount, and $Z_w$ is a condensation coefficient defined by a ratio between a loss amount and latent heat quantity of condensed water. The latent heat $h_{fg}$ is calculated by the following expression (6), and the increased water amount $\Delta G_w$ is calculated by the following expression (7).

[Mathematical expression 6]

$$h_{fg}=h''-h' \quad \text{Expression (6)}$$

[Mathematical expression 7]

$$\Delta G_w=G(y_2-y_1) \quad \text{Expression (7)}$$

Here, G is a steam flow rate, $y_1$ is a blade cascade inlet wetness fraction, and $y_2$ is a blade cascade outlet wetness fraction. And, h" is a saturated vapor enthalpy, and h' is a saturated water enthalpy.

(Acceleration Loss)

An acceleration loss amount $L_a$ is calculated by the following expression (8).

[Mathematical expression 8]

$$L_a=\frac{1}{2}G_t W^2 C_D \quad \text{Expression (8)}$$

Here, $G_t$ is a blade trailing edge water amount, W is a relative velocity of steam and water droplets, $C_D$ is a drag coefficient, the blade trailing edge water amount $G_t$ is calculated by the following expression (9), and the relative velocity is calculated by the following expression (10).

[Mathematical expression 9]

$$G_t=GyZ_t \quad \text{Expression (9)}$$

[Mathematical expression 10]

$$W=V_s'-V_{da} \quad \text{Expression (10)}$$

Here, G is a steam flow rate, y is a wetness fraction at the blade cascade outlet, and $Z_t$ is a trailing edge deposition rate defined by a ratio between the blade trailing edge water amount and the water amount of the entire passage portion. And, $V_s'$ is a trailing steam velocity, $V_{da}$ is a water droplet velocity, the trailing steam velocity $V_s'$ is calculated by the following expression (11), and the water droplet velocity $V_{da}$ is calculated by the following expression (12).

[Mathematical expression 11]

$$V_s'=0.9V_s=0.9\sqrt{(h_i-h_o)} \quad \text{Expression (11)}$$

[Mathematical expression 12]

$$V_{da}=\delta_a V_s \quad \text{Expression (12)}$$

Here, $V_s$ is a steam velocity, δa is an acceleration loss velocity ratio defined by a ratio between a water droplet velocity and a steam velocity, hi is a blade cascade inlet enthalpy, and ho is a blade cascade outlet enthalpy.

And, the drag coefficient $C_D$ is calculated by the following expression (13).

[Mathematical expression 13]

$$C_D=27R_e^{-0.84}(0\leq R_e<80)$$

$$C_D=0.271R_e^{0.217}(80\leq R_e\leq 10^4)$$

$$C_D=2(10^4<R_e) \quad \text{Expression (13)}$$

Here, $R_e$ is a Reynolds number and calculated by the following expression (14).

[Mathematical expression 14]

$$R_e=\frac{Wd}{\nu} \quad \text{Expression (14)}$$

Here, W is a relative velocity of steam and water droplets, d is a diameter of large water droplets, ν is a dynamic viscosity coefficient, and the large water droplet diameter d is calculated by the following expression (15).

[Mathematical expression 15]

$$d=\frac{W_e\sigma}{\rho W^2} \quad \text{Expression (15)}$$

Here, $W_e$ is a Weber number, σ is a surface tension, ρ is a density, and W is a relative velocity.

(Braking Loss)

A braking loss amount $L_b$ is calculated by the following expression (16).

[Mathematical expression 16]

$$L_b=G_t U W_{imp} \quad \text{Expression (16)}$$

Here, $G_t$ is a blade trailing edge water amount, U is a peripheral velocity, $W_{imp}$ is a water droplet collision velocity, the blade trailing edge water amount $G_t$ is calculated by the following expression (17), and the water droplet collision velocity $W_{imp}$ is calculated by the following expression (18).

[Mathematical expression 17]

$$G_t=Gy_2Z_m \quad \text{Expression (17)}$$

[Mathematical expression 18]

$$W_{imp}=U-V_{db}\cos\alpha \quad \text{Expression (18)}$$

Here, G is a steam flow rate, $y_2$ is a stationary blade cascade outlet wetness fraction, $Z_{tn}$ is a stationary blade trailing edge deposition rate defined by a ratio between the blade trailing edge water amount and a water amount of the entire passage portion, U is a peripheral velocity, $V_{db}$ is a water droplet velocity, $\alpha$ is an outflow angle, and the water droplet velocity $V_{db}$ is calculated by the following expression (19).

[Mathematical expression 19]

$$V_{db}=\delta_b V_s=\delta_b\sqrt{(h_1-h_2)} \quad \text{Expression (19)}$$

Here, $V_s$ is a steam velocity, $\delta_b$ is a braking loss velocity ratio defined by a ratio of the water droplet velocity and the steam velocity, $h_1$ is a stationary blade cascade inlet enthalpy, and $h_2$ is a stationary blade cascade outlet enthalpy.

(Capture Loss)

A capture loss amount $L_c$ is calculated by the following expression (20).

[Mathematical expression 20]

$$L_c=\frac{1}{2}G_i V_{dc}^2 \quad \text{Expression (20)}$$

Here, $G_i$ is a collided water amount, $V_{dc}$ is a water droplet velocity, the collided water amount $G_i$ is calculated by the following expression (21), and the water droplet velocity $V_{dc}$ is calculated by the following expression (22).

[Mathematical expression 21]

$$G_i=GyZ_i \quad \text{Expression (21)}$$

[Mathematical expression 22]

$$V_{dc}=\delta_c V_s=\delta_c\sqrt{(h_i-h_0)} \quad \text{Expression (22)}$$

Here, G is a steam flow rate, y is a blade cascade outlet wetness fraction, $Z_i$ is a water collision rate defined by a ratio between the collided water amount and the water amount of the entire passage portion, $V_s$ is a steam velocity, $\delta_c$ is a capture loss velocity ratio defined by a ratio between a water droplet velocity and a steam velocity, $h_i$ is a blade cascade inlet enthalpy, and $h_o$ is a blade cascade outlet enthalpy.

(Pumping Loss)

A pumping loss amount $L_p$ is calculated by the following expression (23).

[Mathematical expression 23]

$$L_p=G_b(U_O^2-U_I^2) \quad \text{Expression (23)}$$

Here, $G_b$ is a blade surface-deposited water amount, $U_O$ is an outer peripheral velocity, $U_I$ is an inner peripheral velocity, and the blade surface-deposited water amount $G_b$ is calculated by the following expression (24).

[Mathematical expression 24]

$$G_b=Gy_3Z_b \quad \text{Expression (24)}$$

Here, G is a steam flow rate, $y_3$ is a rotor blade cascade outlet wetness fraction, $Z_b$ is a blade surface deposition rate defined by a ratio between the blade surface-deposited water amount and the water amount of the entire passage portion.

The arithmetic processing unit 10 calculates the rotor blade cascade outlet enthalpy on the basis of the results of the each loss amount calculated in the step S22 and the results calculated in the step S20, and judges whether the calculated rotor blade cascade outlet enthalpy has a value in the predetermined range, and if it is not the value in the predetermined range, corrects the rotor blade cascade outlet enthalpy assumed in the step S20, and performs the calculation from the step S20 again (arrow from step S22 to step S20 in FIG. 2).

Meanwhile, if the calculated rotor blade cascade outlet enthalpy has a value in the predetermined range, a moisture loss amount at the turbine stage comprising the stationary blade cascade and the rotor blade cascade is calculated on the basis of the resulted amount of each loss calculated in the above-described step S22 (step S23). The moisture loss amount is calculated by summing the individual loss amounts.

Here, as the value in the predetermined range, for example, a range that a difference between the initial value and the calculated value is 0.01% is determined. And, if the calculated rotor blade cascade outlet enthalpy is not the value in the predetermined range, the rotor blade cascade outlet enthalpy assumed in the step S20 is corrected with the calculated value set to the initial value.

In the step S23, the moisture loss amount is calculated, and when the calculation of the moisture loss amount is completed for the stationary blade cascade and the rotor blade cascade of one turbine stage, the processing from the step S20 is performed on the stationary blade cascade and the rotor blade cascade of the next turbine stage by the same manner as described above.

As described above, according to the calculation method of moisture loss in the steam turbine of the embodiment, the moisture loss is classified into the individual losses (supersaturation loss, condensation loss, acceleration loss, braking loss, capture loss, and pumping loss) depending on a phenomenon, and the individual losses can be judged whether they are applied depending on the steam conditions. And, the above loss amounts can be formulated as functions of plural design factors selected from the steam conditions, the fluid conditions, the passage portion shape, and the blade shape.

The calculation method of moisture loss in the steam turbine of the embodiment can be applied to a system that performs fluid analysis of the steam turbine or design calculation of the steam turbine. As the moisture loss, there are a profile loss due to formation of a water film on the blade surface and a loss caused when large water droplets blown off from the blade trailing edge are atomized by spray action, but it is considered that the above losses are comparatively few, and they are not included in the moisture loss of the above embodiment. It is also possible to include the above losses depending on the steam conditions, the fluid conditions or the like.

(Evaluation of Calculated Results by Moisture Loss Calculation Method)

Turbine efficiencies of three turbine stages calculated according to actual measured values by using a testing turbine were compared with the turbine efficiencies of three turbine stages calculated by the calculation method of moisture loss in the steam turbine of the embodiment by using the same model as the testing turbine.

Figure 7:
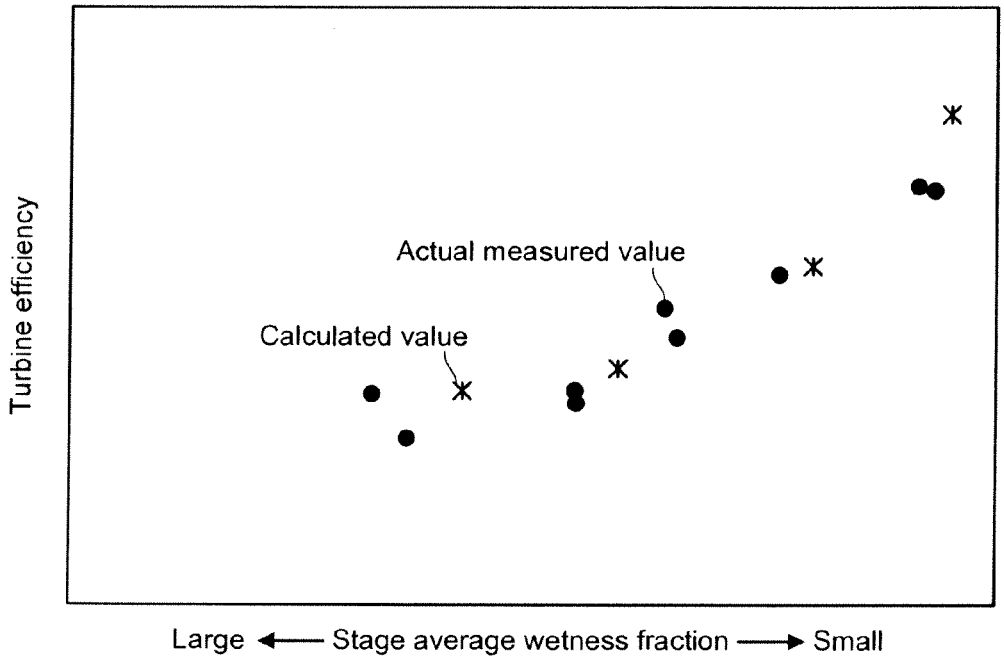
FIG. 7 is a view showing the turbine efficiency calculated according to an actual measured value and the turbine efficiency calculated by the calculation method of moisture loss in a steam turbine according to an embodiment.

FIG. 7 is a diagram showing the turbine efficiencies calculated based on the actual measured values, and the turbine efficiencies calculated by the calculation method of moisture loss in the steam turbine of the embodiment. The horizontal axis of FIG. 7 indicates a turbine stage average wetness fraction that the wetness fractions of three turbine stages are assigned with weights by the heat drop of each turbine stage.

As shown in FIG. 7, the turbine efficiencies calculated according to the actual measured values and the turbine efficiencies calculated by the calculation method of moisture loss in the steam turbine of the embodiment have the same tendency. From the results, the validity of the calculation method of moisture loss in the steam turbine of the embodiment could be proved.

According to the embodiments described above, the moisture loss amount in the steam turbine can be calculated accurately and easily.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A calculation method for calculating an amount of moisture loss in a steam turbine generated when a steam condition in the steam turbine becomes wet steam, the moisture loss comprising loss elements including (1) supersaturation loss generated when steam expands so as to supersaturate at a blade cascade, (2) condensation loss generated when steam around water droplets condenses, (3) acceleration loss generated due to a difference in velocity between water droplets and steam, (4) braking loss generated when water droplets collide against suction sides of rotor blades, (5) capture loss generated when water droplets collide against surfaces of stationary and rotor blades, and (6) pumping loss generated when water droplets adhere to the surfaces of the rotor blades, wherein a computer is configured to store information to permit selection from among the loss elements on a basis of a calculated wetness fraction, the calculation method comprising:

calculating, via the computer, a wetness fraction at each of an inlet and an outlet of each of a stationary blade cascade and a rotor blade cascade;

selecting, via the computer, relevant loss from among the loss elements so as to calculate the amount of moisture loss based on the calculated wetness fractions and the information stored in the computer;

calculating, via the computer, an amount of each loss selected from among the loss elements; and calculating, via the computer, the amount of moisture loss at each blade cascade on a basis of each calculated amount of each loss selected from among the loss elements.

2. The calculation method for calculating an amount of moisture loss in the steam turbine according to claim 1, wherein, when boundary values of the wetness fractions are determined to be $y_w$ in selecting the loss for calculation of the amount of moisture loss from among the loss elements (1) to (6) based on the calculated wetness fractions and the stored information, the selecting of the loss includes selecting the supersaturation loss when the wetness fraction $y_i$ at the inlet of the blade cascade is expressed as $0 \leq y_i \leq y_w$ and the wetness fraction $y_o$ at the outlet of the blade cascade is expressed as $0 < y_o \leq y_w$;

the selecting of the loss includes selecting the supersaturation loss, the condensation loss, the acceleration loss, the capture loss, and the pumping loss and the calculating of the amount of moisture loss includes summing the selected loss elements when the wetness fraction $y_i$ at the inlet of the blade cascade is expressed as $0 \leq y_i \leq y_w$ and the wetness fraction $y_o$ at the outlet of the blade cascade is expressed as $y_o > y_w$; and the selecting of the loss includes selecting the condensation loss, the acceleration loss, the braking loss, the capture loss, and the pumping loss and the calculating of the amount of moisture loss includes summing the selected loss elements when the wetness fraction $y_i$ at the inlet of the blade cascade is expressed as $y_i > y_w$ and the wetness fraction $y_o$ at the outlet of the blade cascade is expressed as $y_o > y_w$.

3. The calculation method for calculating an amount of moisture loss in the steam turbine according to claim 1, wherein a boundary value $y_w$ is in a range of a wetness fraction of 3% to 5%.

4. The calculation method for calculating an amount of moisture loss in the steam turbine according to claim 1, wherein an amount of the supersaturation loss is calculated on a basis of an adiabatic heat drop, a supersaturation efficiency and a steam flow rate at the blade cascade;

wherein the supersaturation efficiency is calculated on a basis of a dry specific heat ratio, a wet specific heat ratio, a pressure at the inlet of the blade cascade and a pressure at the outlet of the blade cascade;

wherein the dry specific heat ratio is a specific heat ratio at a position on a specific heat diagram where an expansion curve and a saturated vapor line according to the blade cascade mutually intersect, and wherein the wet specific heat ratio is a specific heat ratio at a position on a specific heat ratio diagram where the pressure at the outlet of the blade cascade and the wetness fraction at the outlet of the blade cascade mutually intersect.

* * * * *